US011054138B2

(12) United States Patent
Cho et al.

(10) Patent No.: US 11,054,138 B2
(45) Date of Patent: Jul. 6, 2021

(54) SHROUD STRUCTURE FOR IMPROVING SWOZZLE FLOW AND COMBUSTOR BURNER USING THE SAME

(71) Applicant: DOOSAN HEAVY INDUSTRIES & CONSTRUCTION CO., LTD., Changwon-si (KR)

(72) Inventors: Moon Soo Cho, Seoul (KR); In Chan Choi, Gwangyang-si (KR)

( * ) Notice: Subject to any disclaimer, the term of this patent is extended or adjusted under 35 U.S.C. 154(b) by 239 days.

(21) Appl. No.: 16/111,165

(22) Filed: Aug. 23, 2018

(65) Prior Publication Data

US 2019/0107281 A1 Apr. 11, 2019

(30) Foreign Application Priority Data

Oct. 11, 2017 (KR) ..... 10-2017-0130104

(51) Int. Cl.
*F23R 3/14* (2006.01)
*F23R 3/46* (2006.01)
*F23R 3/28* (2006.01)

(52) U.S. Cl.
CPC ..... *F23R 3/14* (2013.01); *F23R 3/286* (2013.01); *F23R 3/46* (2013.01)

(58) Field of Classification Search
CPC ..... F23R 3/04; F23R 3/06; F23R 3/10; F23R 3/16; F23R 3/286; F23R 3/002
See application file for complete search history.

(56) References Cited

U.S. PATENT DOCUMENTS 6,494,044 B1 12/2002 Bland
8,024,932 B1 9/2011 Stewart
(Continued)

FOREIGN PATENT DOCUMENTS

JP H03225117 A 10/1991
JP 2005233574 9/2005
(Continued)

OTHER PUBLICATIONS

A Korean Office Action dated Sep. 24, 2019 in connection with Korean Patent Application No. 10-2017-0130104.
(Continued)

*Primary Examiner* — Gerald L Sung
*Assistant Examiner* — Jacek Lisowski

(57) ABSTRACT

A shroud structure and a combustor burner using the shroud structure are provided for improving swozzle flow. The shroud structure includes a shroud configured to surround a combustion nozzle and a plurality of swirlers provided along a circumferential row of the combustion nozzle, the shroud having an outer circumferential surface in which a plurality of inlets are formed to draw in compressed air flowing outside the shroud, the compressed air being drawn into the shroud before being mixed with fuel. The inlets are disposed, at positions spaced apart from each other, before a circumferential row of the outer circumferential surface of the shroud that faces a first fuel injector provided on an inner circumferential surface of a combustor casing so that compressed air guided into the inlet is supplied to a region formed around a second fuel injector provided in the swirlers in the shroud.

17 Claims, 8 Drawing Sheets

(56) References Cited

U.S. PATENT DOCUMENTS

| | | | | |
|---|---|---|---|---|
| 2012/0047908 | A1* | 3/2012 | Poyyapakkam | F23R 3/002 60/774 |
| 2012/0099960 | A1* | 4/2012 | Bathina | F23R 3/283 415/1 |
| 2012/0305670 | A1* | 12/2012 | Flamand | F23D 14/82 239/518 |
| 2014/0174089 | A1* | 6/2014 | Melton | F23R 3/005 60/740 |
| 2015/0260407 | A1* | 9/2015 | Crothers | F02C 7/22 60/776 |
| 2016/0178202 | A1* | 6/2016 | Antoniono | F23R 3/286 60/782 |

FOREIGN PATENT DOCUMENTS

| | | | |
|---|---|---|---|
| JP | 2009133599 | A | 6/2009 |
| JP | 2010243150 | A | 10/2010 |
| JP | 2013140004 | A | 7/2013 |
| JP | 5896644 | B2 | 3/2016 |
| KR | 101443929 | B1 | 9/2014 |
| KR | 101625865 | B1 | 5/2016 |

OTHER PUBLICATIONS

A Korean Office Action dated Jan. 9, 2019 in connection with Korean Patent Application No. 10-2017-0130104.

* cited by examiner

【FIG. 1】
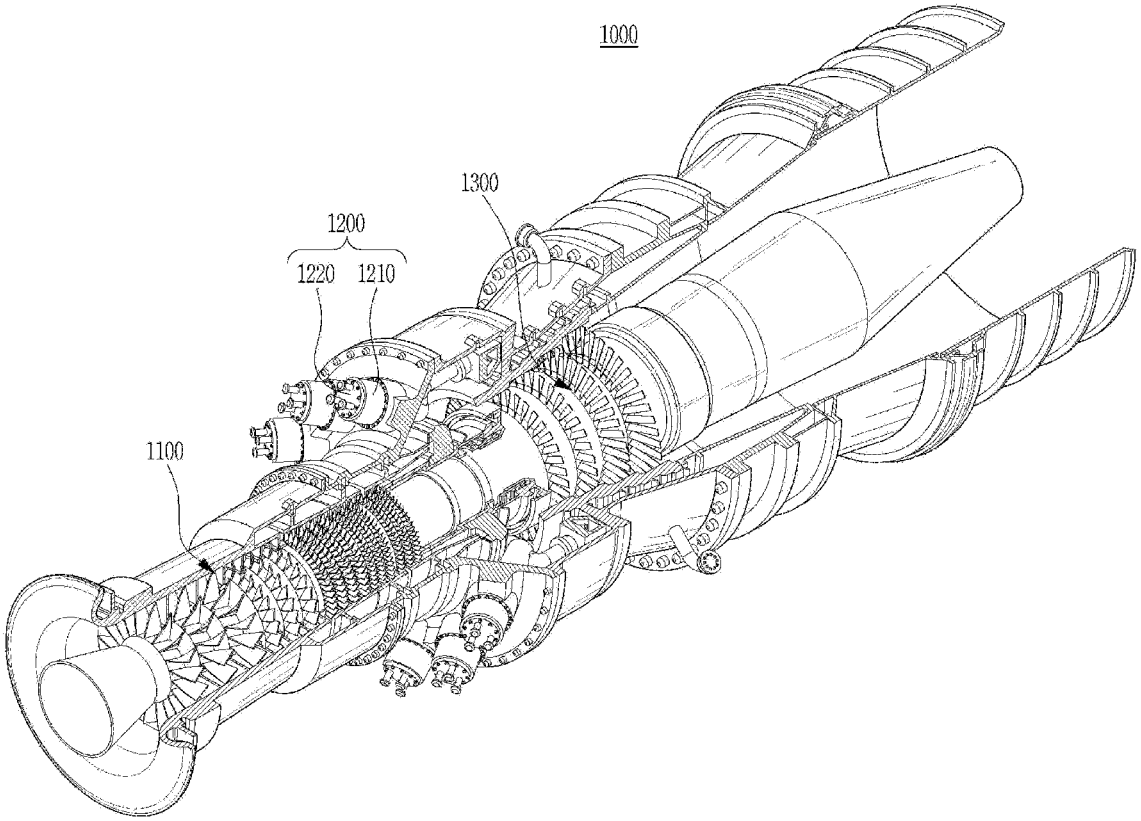

【FIG. 2】
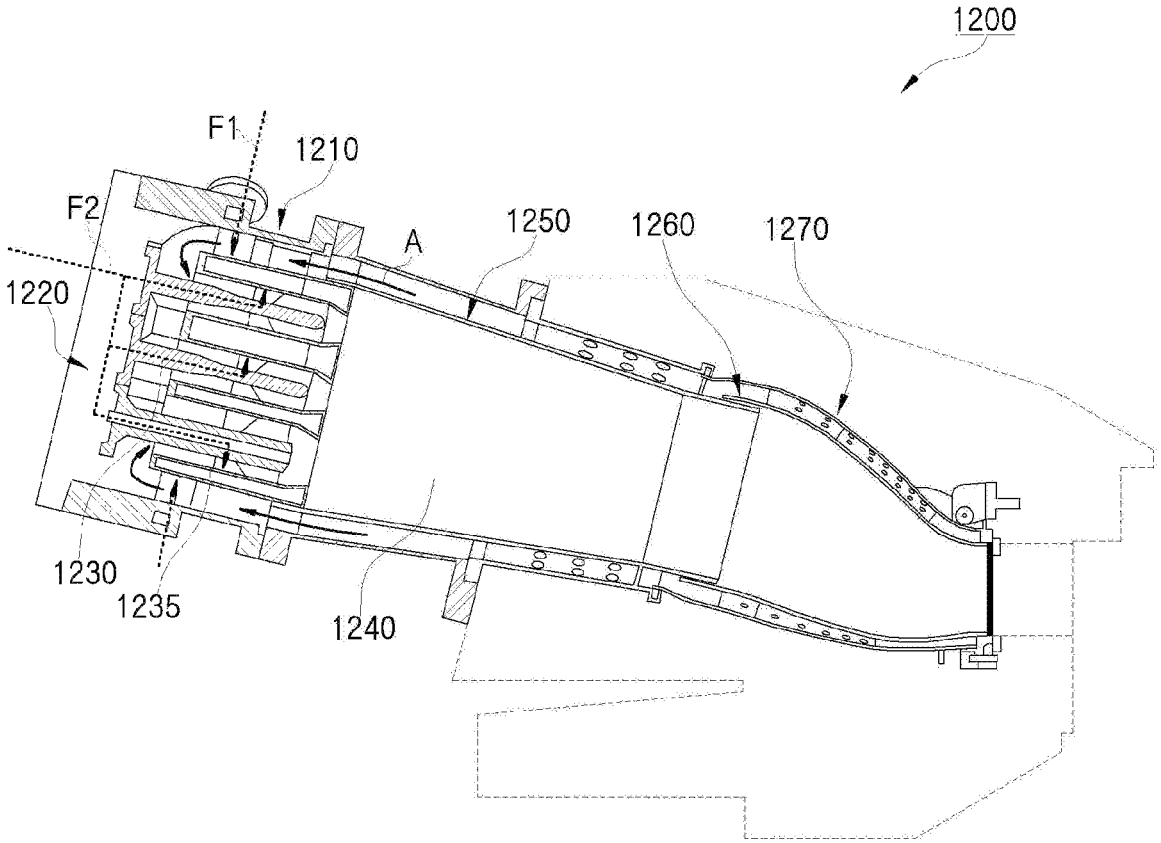

【FIG. 3】
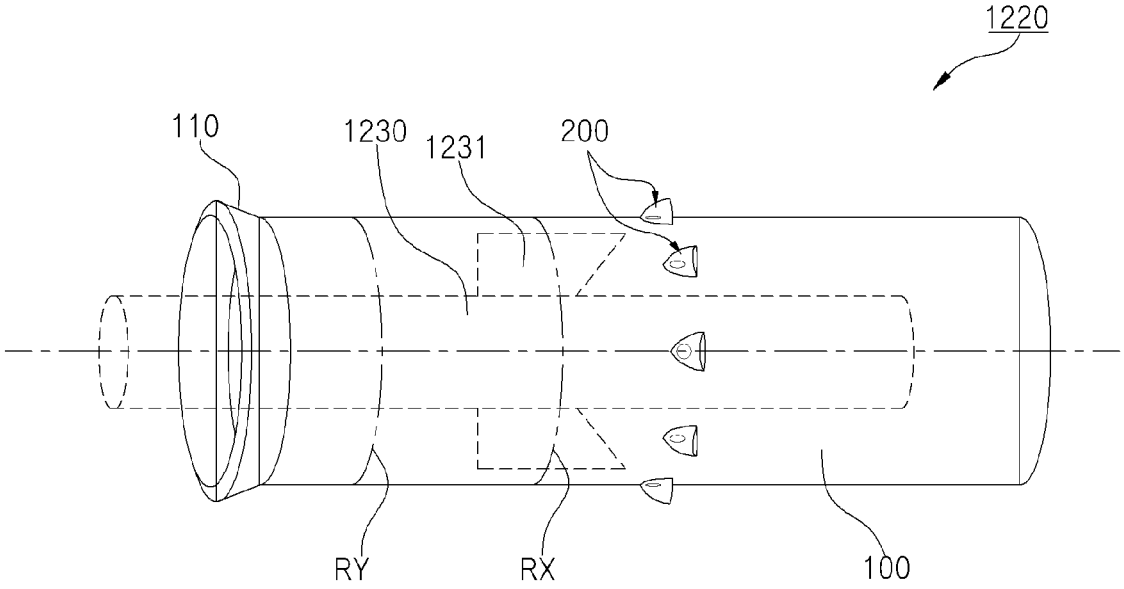

【FIG. 4】
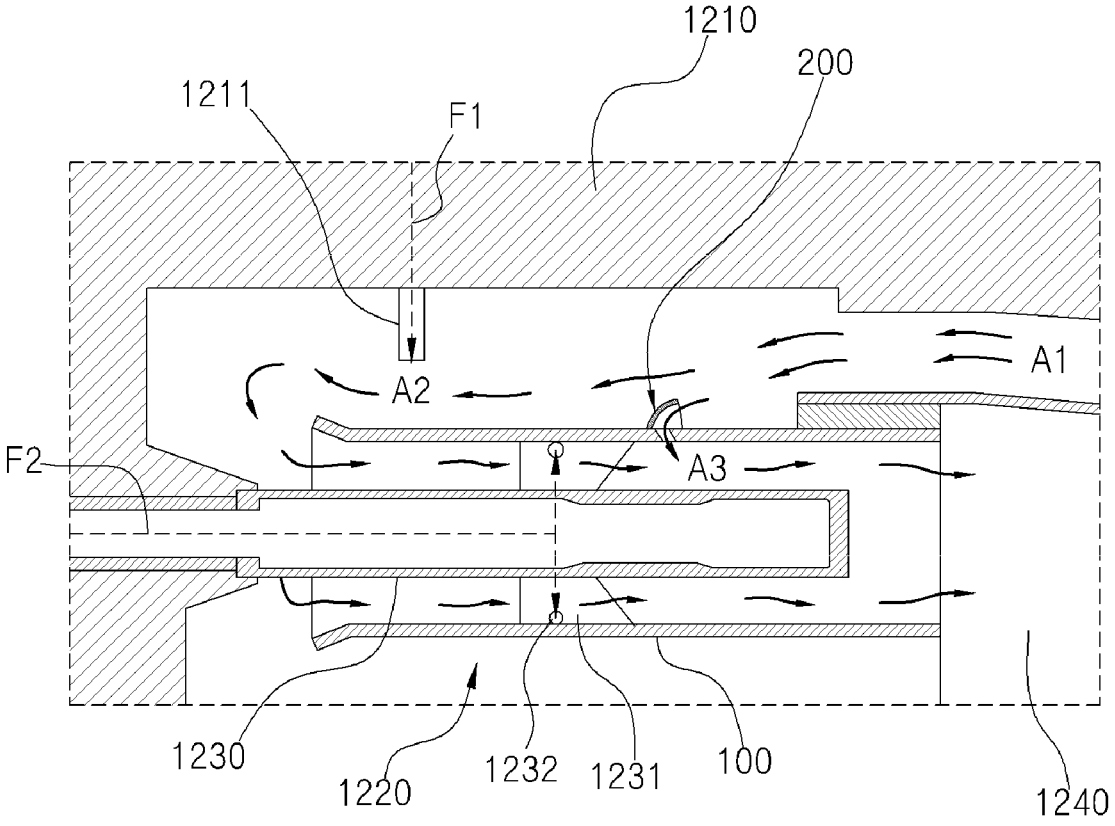

【FIG. 5A】
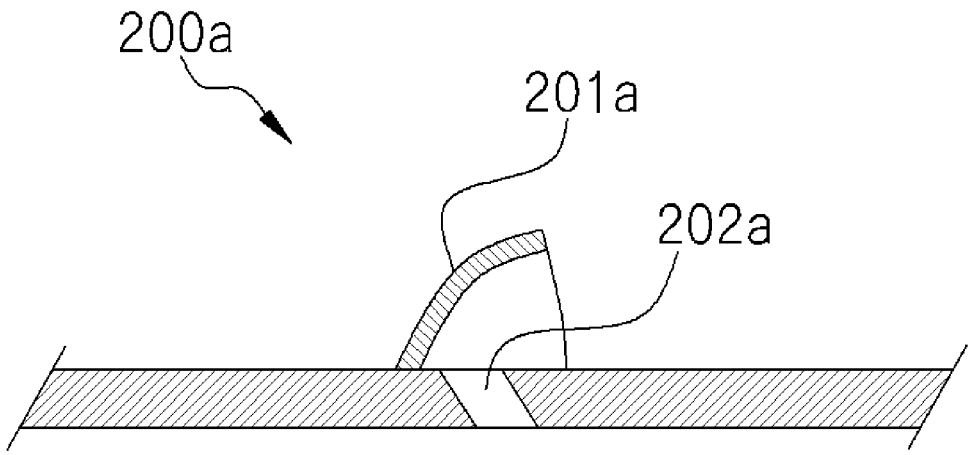
【FIG. 5B】
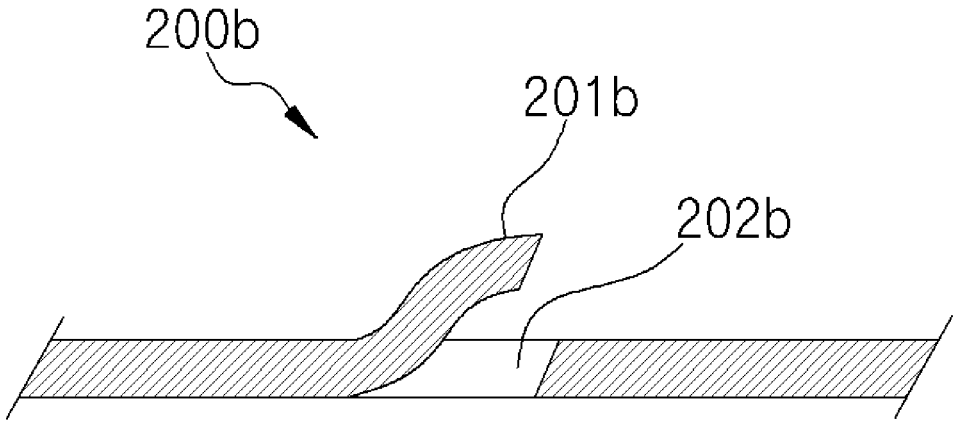

【FIG. 6A】
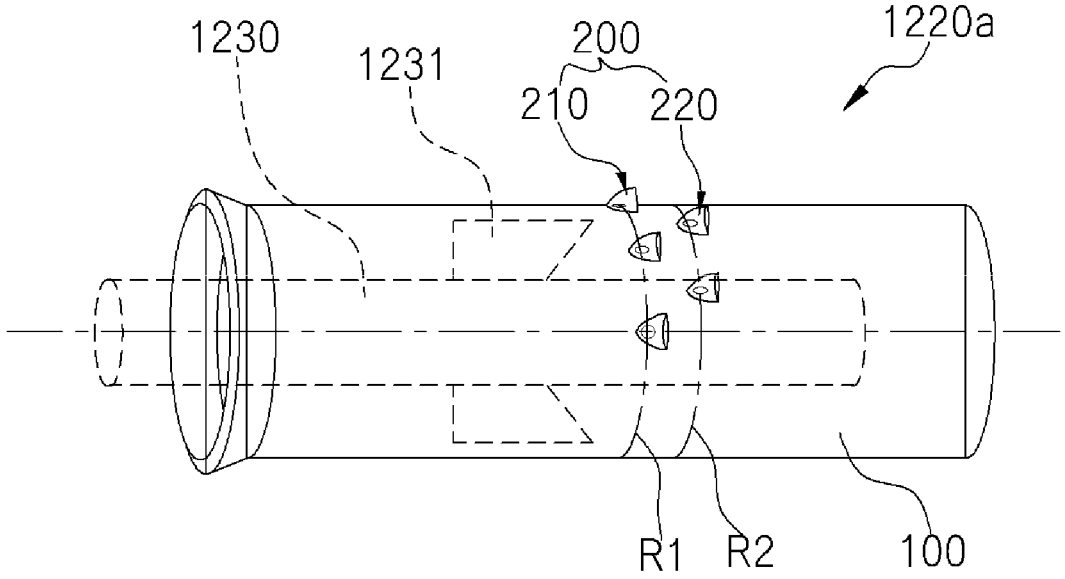
【FIG. 6B】
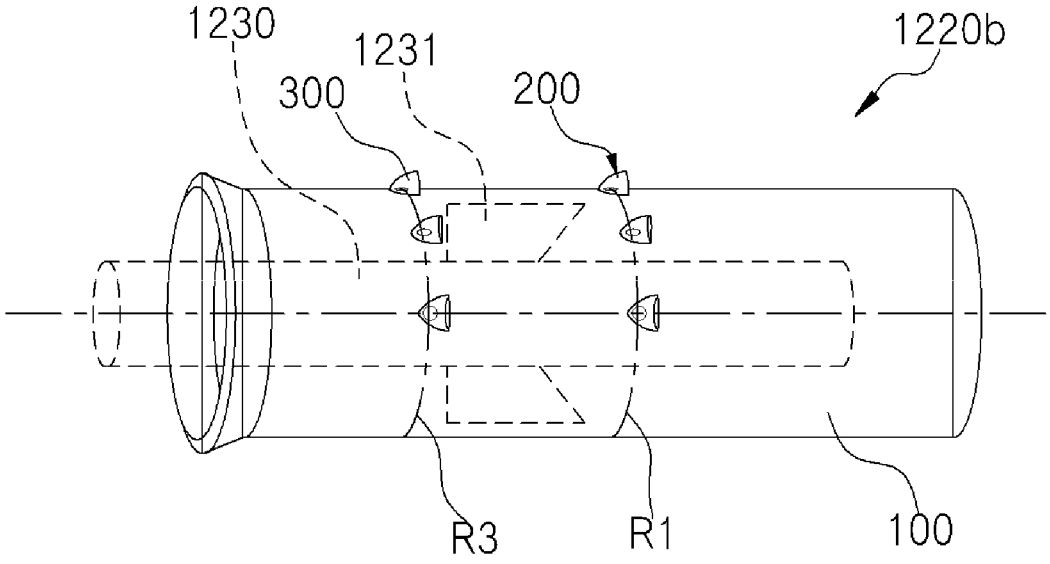

【FIG. 7A】
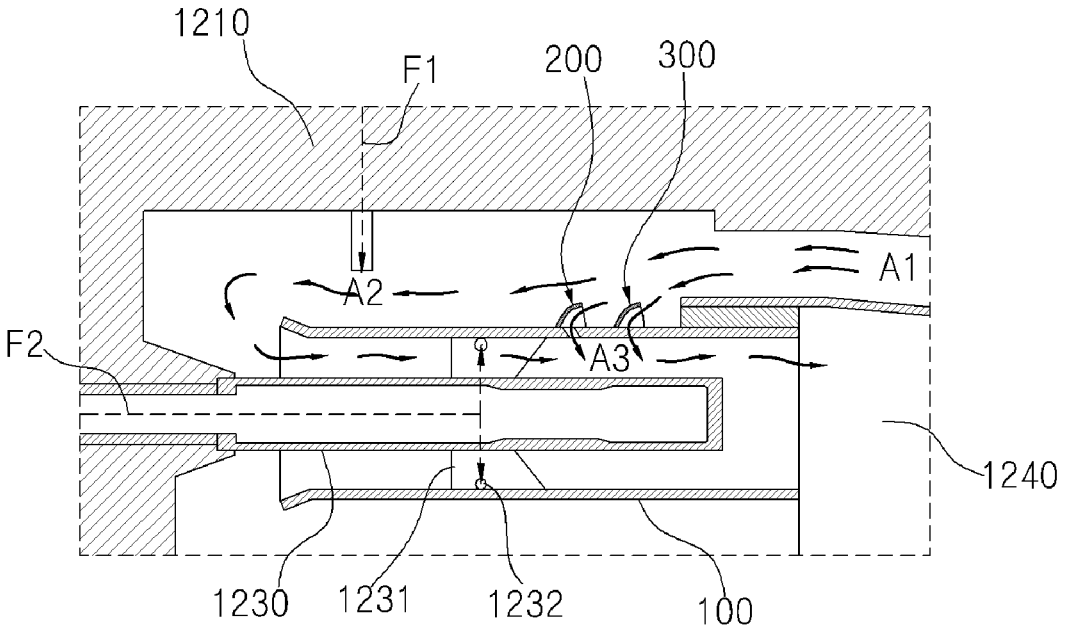
【FIG. 7B】
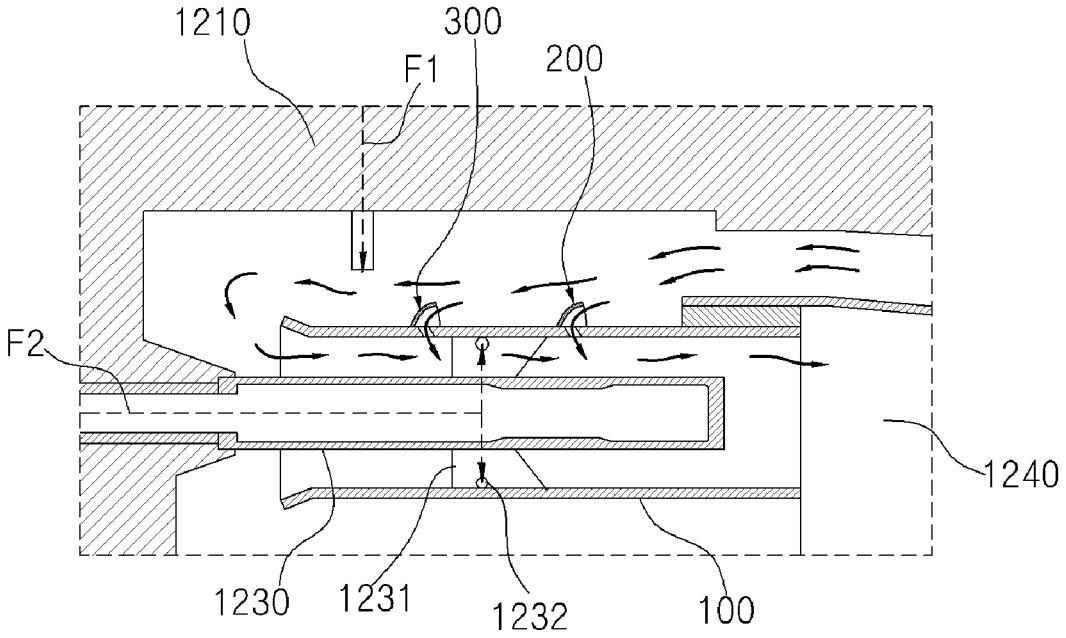

【FIG. 8】
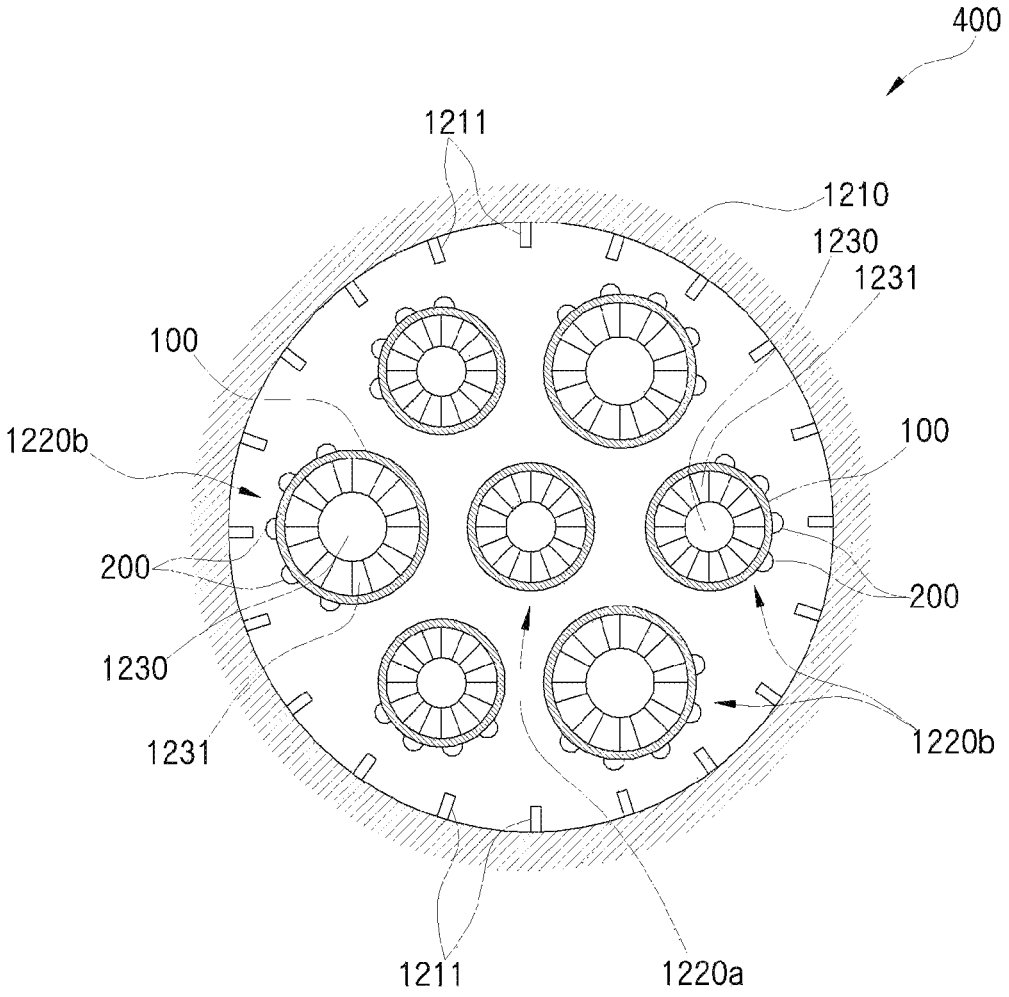

SHROUD STRUCTURE FOR IMPROVING SWOZZLE FLOW AND COMBUSTOR BURNER USING THE SAME

CROSS-REFERENCE TO RELATED APPLICATIONS

This application claims priority to Korean Patent Application No. 10-2017-0130104, filed on Oct. 11, 2017, the disclosure of which is incorporated herein by reference in its entirety.

BACKGROUND OF THE DISCLOSURE

Field of the Disclosure

Exemplary embodiments of the present disclosure relate to a gas turbine, and more particularly, to a shroud structure employed in a burner for a gas turbine combustor.

Description of the Related Art

A combustor for gas turbines is provided between a compressor and a turbine, and functions to mix fuel with compressed air supplied from the compressor, combust the mixture through an isobaric process to produce combustion gas having high energy, and transmit the combustion gas to the turbine which converts thermal energy of the combustion gas into mechanical energy.

To this end, the combustor has a structure for mixing compressed air provided from the compressor with fuel in a combustor casing, and igniting and combusting the mixture in a combustion chamber inside a liner. In detail, compressed air drawn along an inner surface of a tube assembly of the combustor is supplied toward a combustion nozzle and then begins to be mixed with fuel while flowing into an annular combustor casing. This passes through a process in which air is injected along the flow of air successively into fuel injection units to which fuel is provided through respective independent routes (refer to FIG. 2). This flow of pre-mixed air is closely related to the shape and structure of a shroud employed in a combustor burner. The pre-mixed air may be produced through a combination of a swirler and the nozzle, or a swozzle.

However, the simple flow route of a contemporary shroud structure cannot achieve efficient combustion. That is, the process of forming pre-mixed air using such a shroud structure cannot realize the fuel-to-compressed air ratio needed for efficient combustion. Furthermore, conventional techniques for holding a flame use vortex currents generated by the flow of fluid passing through a swirler in the shroud, but such a flame holding structure lacks the supporting force sufficient to reliably block backward currents (flashback).

RELATED DOCUMENT

Patent Document (Patent document 1) U.S. Pat. No. 8,024,932 (entitled "SYSTEM AND METHOD FOR COMBUSTOR NOZZLE")

SUMMARY OF THE DISCLOSURE

An object of the present disclosure is to provide a shroud structure capable of maximizing an effect of mixing compressed air and fuel provided for pre-mixed combustion and capable of reinforcing a flame holding structure in order to prevent backward currents of flames from being drawn into the shroud. Another object of the present disclosure is to provide a combustor burner for gas turbines using the shroud structure.

In accordance with one aspect of the present disclosure, there is provide a shroud structure for improving swozzle flow. The shroud structure may include a shroud configured to surround a combustion nozzle and a plurality of swirlers provided along a circumferential row of the combustion nozzle, the shroud having an outer circumferential surface in which an inlet is formed to draw in compressed air flowing outside the shroud, the compressed air being drawn into the shroud before being mixed with fuel. The inlet may be disposed before a circumferential row of the outer circumferential surface of the shroud that faces a first fuel injector provided on an inner circumferential surface of a combustor casing so that compressed air guided into the inlet is supplied to a region formed around a second fuel injector provided in the swirlers in the shroud.

The inlet may include a plurality of inlets disposed at positions spaced apart from each other along a circumferential row of the outer circumferential surface of the shroud.

The inlets may be disposed in only a portion of the outer circumferential surface of the shroud that faces the inner circumferential surface of the combustor casing.

The inlets may be disposed such that the compressed air drawn into the shroud represents 10% to 20% of a flow rate of the compressed air flowing outside the shroud.

The inlet may be formed before a circumferential row of the outer circumferential surface of the shroud that corresponds to a position at which the swirlers are formed.

The inlet may include an air collector provided around an inlet hole, the air collector configured to gather compressed air flowing through a predetermined region around the inlet hole and to direct the gathered air through the inlet hole. The air collector may be formed of a scoop, or may be formed by punching and pressing outward a portion of the outer circumferential surface of the shroud in which the inlet hole is to be formed.

The inlets may be disposed in at least two circumferential rows.

The inlets disposed in a first circumferential row and a second circumferential row may be alternately disposed with respect to a circumferential row.

In accordance with another aspect of the present disclosure, there is provided a burner configured to form a combustor and provided with a shroud structure for improving swozzle flow. The burner may include a combustion nozzle configured to eject fuel to be mixed with compressed air; a plurality of swirlers provided along a circumferential direction of the combustion nozzle; and the above shroud.

In accordance with another aspect of the present disclosure, there is provided a burner assembly in which a plurality of burners are disposed along a combustor casing having an annular shape. Each burner is consistent with the above burner. The plurality of burners may include a center burner provided in an internal center of the combustor casing, and a plurality of auxiliary burners provided around the center burner. The inlet may be formed in an outer circumferential surface of each of the shrouds of only the auxiliary burners, or in an outer circumferential surface of each of the shrouds of only the burners that face the combustor casing.

As a shroud structure in accordance with the present disclosure is applied to a burner and a combustor for gas turbines including the burner, the effect of mixing compressed air and fuel provided for pre-mixed combustion is maximized, and an air barrier in the shroud is reinforced so that backward currents of flames (flashback) can be effectively blocked.

Furthermore, since pure compressed air is drawn at an optimum flow rate into the shroud through which pre-mixed air passes, the amount of nitrogen oxide, etc. can be reduced, so that the quality of exhaust gas can be improved.

The effects of the present disclosure are not limited to the above-stated effects, and those skilled in the art will clearly understand other not mentioned effects from the accompanying claims.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a cutaway perspective view of a gas turbine to which may be applied a combustor burner in accordance with the present disclosure;

FIG. 2 is a schematic sectional view of a combustor and a burner of the gas turbine of FIG. 1, for illustrating a flow of pre-mixed air;

FIG. 3 is a schematic perspective view of a shroud structure for improving swozzle flow in accordance with an embodiment of the present disclosure;

FIG. 4 is a sectional view of the shroud structure of FIG. 3;

FIGS. 5A and 5B are schematic side views of an inlet hole and a collecting unit, respectively, which are formed in the shroud structure of FIG. 3;

FIGS. 6A and 6B are schematic perspective views of a shroud structure for improving swozzle flow in accordance with other embodiments of the present disclosure;

FIGS. 7A and 7B are sectional views of the shroud structures of FIGS. 6A and 6B, respectively; and FIG. 8 is a cross-sectional view of a burner assembly to which may be applied the shroud structure for improving swozzle flow in accordance with the present disclosure.

DESCRIPTION OF SPECIFIC EMBODIMENTS

Terms or words used hereinafter should not be construed as having common or dictionary meanings, but should be construed as having meanings and concepts that comply with the technical spirit of the present disclosure on the basis of the principle that the inventor may appropriately define the concepts of the terms in order to best describe his or her disclosure. Accordingly, the following description and drawings illustrate exemplary embodiments of the present disclosure and do not fully represent the scope of the present disclosure. It would be understood by one of ordinary skill in the art that a variety of equivalents and modifications of the embodiments exist.

Embodiments of the present disclosure will be described in detail below with reference to the accompanying drawings.

In the drawings, the width, length, thickness, etc. of each element may have been enlarged for convenience. Furthermore, when it is described that one element is disposed 'over' or 'on' the other element, one element may be disposed 'right over' or 'right on' the other element or a third element may be disposed between the two elements. The same reference numbers are used throughout the specification to refer to the same or like parts.

Furthermore, the terms "first", "second", "A", "B", "(a)", "(b)", etc. may be used herein to describe various components of the embodiments of the present disclosure. These terms are only used to distinguish each component from another component, and do not limit the characteristics, turns, or sequences of the corresponding components. It is also noted that in this specification, "connected/coupled" refers to one component not only directly coupling another component but also indirectly coupling another component through an intermediate component.

The thermodynamic cycle of a gas turbine ideally complies with the Brayton cycle. The Brayton cycle consists of four processes including an isentropic compression (adiabatic compression) process, an isobaric heat supply process, an isentropic expansion (adiabatic expansion) process, and an isobaric heat rejection process. In other words, the gas turbine draws air from the atmosphere, compresses the air to high pressure, combusts fuel under isobaric conditions to emit thermal energy, expands this high-temperature combustion gas to convert the thermal energy of the combustion gas into kinetic energy, and thereafter discharges exhaust gas with residual energy to the atmosphere. As such, the Brayton cycle consists of four processes including compression, heat addition, expansion, and heat rejection. Embodying the Brayton cycle, the gas turbine includes a compressor, a combustor, and a turbine.

FIG. 1 illustrates the overall configuration of a gas turbine 1000. Although the following description will be made with reference to FIG. 1, the description of the present disclosure may also be widely applied to a turbine engine having the same or similar configuration as that of the gas turbine 1000.

The gas turbine 1000 includes a compressor 1100 functioning to draw air and compress the air. A main function of the compressor 1100 is to supply air for combustion to the combustor 1200 and supply air for cooling to a high-temperature region of the gas turbine 1000 which requires cooling. Drawn air is compressed in the compressor 1100 through an adiabatic compression process, which increases the pressure and the temperature of air passing through the compressor 1100.

The compressor 1100 is usually designed in the form of a centrifugal compressor or an axial compressor. Generally, the centrifugal compressor is used in a small gas turbine. On the other hand, in a large gas turbine such as the gas turbine 1000, a multi-stage axial compressor 1100 is generally used so as to compress a large amount of air. A rotating shaft of the compressor 1100 is directly coupled with a rotating shaft of the turbine 1300, so that the compressor 1100 is operated using some of the power output from the turbine 1300.

FIG. 2 illustrates an example of the combustor 1200 provided in the gas turbine 1000. The combustor 1200 functions to mix fuel with compressed air supplied from an outlet of the compressor 1100 and combust the mixture through an isobaric combustion process to produce a combustion gas having high energy. Thus, the combustor 1200 is disposed downstream of the compressor 1100 and includes a plurality of burners 1220 disposed along a combustor casing 1210 having an annular shape. A plurality of combustion nozzles 1230 are provided in each burner 1220. Fuel ejected from the combustion nozzles 1230 is mixed with air at an appropriate ratio to form a mixture having conditions suitable for combustion.

The fuel utilized by the gas turbine 1000 may be a gas fuel, a liquid fuel, or a hybrid fuel combining these two. The use of such fuel is accompanied with strict regulations pertaining to emissions of carbon monoxide, nitrogen oxide, etc.

The kinds of combustion occurring in the gas turbine 1000 may be chiefly classified into diffusion combustion and pre-mixing combustion. Diffusion combustion is a combustion scheme in which only fuel is discharged from the combustion nozzles 1230 and air needed for combustion is introduced by diffusion around flames, so that air and fuel are slowly mixed with each other and combusted. In the case of diffusion combustion, although the speed of combustion is low and flame temperatures are low, there are advantages in that there is no risk of flashback (backfire), and it is easy to control the combustion, whereby the combustion can be stably maintained. Pre-mixing combustion, on the other hand, is a combustion scheme in which fuel and air are mixed before being discharged through the combustion nozzles 1230 and combusted. Pre-mixing combustion has characteristics opposite to those of diffusion combustion.

It is important to create a combustion environment capable of reducing the amount of exhaust gas such as carbon monoxide and nitrogen oxide. Given this, although it is relatively difficult to control the combustion, the pre-mixing combustion scheme is advantageous in that a high-temperature region in which nitrogen oxide occurs can be reduced by maintaining a constant temperature of combustion. Since reducing nitrogen oxide is the most difficult goal to achieve in the exhaust gas regulations, the use of the pre-mixing combustion scheme has recently increased.

A technique using swozzle flow, in which swirlers are installed around each combustion nozzle 1230 to promote pre-mixing of air and fuel, has been proposed. Initial ignition of pre-mixed gas is performed using an igniter. Thereafter, if combustion is stabilized, the combustion is maintained by supplying fuel and air.

There is a need to appropriately cool the combustor 1200 because the combustor 1200 forms the highest temperature environment in the gas turbine 1000. Referring to FIG. 2, there is illustrated a flow passage through which compressed air flows along an inner surface of a duct assembly, which is coupled between the burner 1220 and the turbine 1300 to allow high-temperature combustion gas to flow through the duct assembly, in other words, along the inner surface of a tube assembly formed of a liner 1250, a transition piece 1260, and a flow sleeve 1270, and then is supplied toward the combustion nozzles 1230. During a process in which compressed air flows along the inner surface of the tube assembly, the duct assembly heated by high-temperature combustion gas can be appropriately cooled.

High-temperature and high-pressure combustion gas generated from the combustor 1200 is supplied to the turbine 1300 through the duct assembly. In the turbine 1300, combustion gas expands through an adiabatic expansion process and collides with a plurality of blades radially disposed on the rotating shaft of the turbine 1300 so that reaction force is applied to the blades. Thus, thermal energy of the combustion gas is converted into mechanical energy by which the rotating shaft is rotated. Some of the mechanical energy obtained in the turbine 1300 is supplied as energy needed to compress air in the compressor 1100, and the remaining mechanical energy is used as valid energy for driving a generator to produce electric power, or the like.

In the gas turbine 1000, major components do not reciprocate. Hence, mutual friction parts such as a piston-and-cylinder are not present, so that there are advantages in that there is little consumption of lubricant, the amplitude of vibration is markedly reduced unlike a reciprocating machine having high-amplitude characteristics, and high-speed driving is possible.

Furthermore, the thermal efficiency in the Brayton cycle increases, as the compression ratio at which air is compressed is increased and the temperature (turbine entrance temperature) of combustion gas drawn into the turbine through an isentropic expansion process is increased. Therefore, the gas turbine 1000 has been developed in such a way as to increase the compression ratio and the entrance temperature of the turbine 1300.

Hereinafter, the shroud structure for improving swozzle flow according to the present disclosure which is applied to the combustor 1200 and the burner 1220 of the gas turbine 1000 will be described in detail with reference to FIGS. 2 to 8.

FIG. 2 illustrates the flow of pre-mixed air in the combustor 1200 and the burner 1220 of the gas turbine 1000.

As described above, the combustor 1200 is configured such that compressed air supplied from the compressor 1100 is mixed with fuel in a region including the combustor casing 1210 and the burner 1220 to form pre-mixed air, and the pre-mixed air is ignited and combusted in a combustion chamber 1240 defined inside the liner 1240. In detail, referring to FIG. 2, the compressed air A that flows along a space defined in a double-shell structure formed of the liner 1250 and the flow sleeve 1270 of the duct assembly enters the interior of the annular combustor casing 1210 and thus begins to be mixed with fuel. During the foregoing process, first fuel F1 and second fuel F2 are successively injected through independent routes. In detail, the first fuel F1 is injected into a space between an inner circumferential surface of the combustor casing 1210 and an outer circumferential surface of the shroud 100 facing the inner circumferential surface of the combustor casing 1210. The second fuel F2 is injected into the shroud 100.

During the process of producing pre-mixed air, a simple flow route would preclude the realization of a relatively large amount of mixing ratio between the fuel (F1, F2) and the compressed air (A) for efficient combustion. In addition, as present in the conventional technique, the flame holding structure using vortex currents generated by the flow of fluid passing through the swirlers in the shroud 100 may have insufficient supporting force to reliably block flashback, or the backward currents of flames. To overcome these problems, the present disclosure aims to form a new swozzle flow by improving the shroud structure that determines the flow of compressed air and pre-mixed air.

FIG. 3 illustrates an overall shape of an embodiment of the shroud structure for improving swozzle flow in accordance with the present disclosure. FIG. 4 illustrates the shroud structure of FIG. 3 to describe the flow of pre-mixed air.

Referring to FIGS. 3 and 4, each burner 1220 of the combustor 1200 includes a combustion nozzle 1230, a plurality of swirlers 1231, and a shroud 100. The combustion nozzle 1230 is provided in the form of a tube for ejecting fuel to be mixed with compressed air A. The swirlers 1231 are disposed in a row around the circumference of the combustion nozzle 1230. Surrounding the combustion nozzle 1230, the shroud 100 houses the swirlers 1231 and thus establishes a swozzle flow of pre-mixed air.

The structure of the shroud 100 according to the present disclosure may be applied to each of the burners 1220 forming the combustor 1200 and need not be constituted as a single, integrally formed member. Hence, so long as the structure according to the present disclosure can be applied to the shroud 100 surrounding the combustion nozzle 1230 and the plurality of swirlers 1231 provided on a circumferential row of the combustion nozzle 1230, the shroud 100 is not limited to having a structure formed of a single member. For example, a portion of the outer circumferential surface of the shroud 100 that surrounds the combustion nozzle 1230 may be formed of a shroud (in the narrow sense) coupled to the swirlers 1231, and another portion of the outer circumferential surface of the shroud 100 that surrounds the combustion nozzle 1230 may be formed as part of a nozzle cap assembly (not shown) provided to enable insertion of the plurality of burners 1220 into a front end of the combustion chamber 1240. As such, the shroud structure may also include a structure in which a plurality of components are assembled to be connected with each other.

Referring to FIGS. 3 and 4, inlets 200 are formed in the outer circumferential surface of the shroud 100. The inlets 200 are disposed before (upstream of) a circumferential row RY of the outer circumferential surface of the shroud 100 that faces a first fuel injector 1211 provided on an inner circumferential surface of the combustor casing 1210, so that compressed air A1 guided into the inlets 200 is supplied to a region formed around a second fuel injector 1232 provided on the swirlers 1231 in the shroud 100. Thus, before being mixed with first fuel F1, the compressed air A1 that flows outside the shroud 100 can be drawn into the shroud 100 and mixed with pre-mixed air A2 and A3. In other words, the inlet holes 200 function to guide the compressed air A1 drawn into the burner 1220, into the internal space of the shroud 100 before the compressed air A1 is converted into the pre-mixed air A2 and A3.

In the present specification, the terms "before" and "after" refer to the directionality of a compressed air flow, such that "before a point" refers to an upstream region based on the direction in which compressed air flows; such that "before a circumferential row of the outer circumferential surface of the shroud 100" indicates an upstream region with respect to the flow direction of compressed air, or rightward in terms of the outer circumferential surface of the shroud 100 in FIG. 4; and such that "after a circumferential row of the inner circumferential surface of the shroud 100" indicates a downstream region with respect to the flow direction of pre-mixed air, or rightward in terms of the inner circumferential surface of the shroud 100 in FIG. 4.

Furthermore, the inlets 200 may be disposed at positions spaced apart from each other along a circumferential row of the outer circumferential surface of the shroud 100. The circumferential row may be disposed before the circumferential row RY of the outer circumferential surface of the shroud 100 that faces the first fuel injector 1211, so that the circumferential row meets pure compressed air that is before a pre-mix step.

In detail, the inlets 200 may be disposed before a circumferential row RX of the outer circumferential surface of the shroud 100 that corresponds to the position at which the swirlers 1231 are formed. In other words, the inlets 200 may be disposed before the circumferential row RY of the outer circumferential surface of the shroud 100 that faces the first fuel injector 1211, and may be disposed after the circumferential row RX of the outer circumferential surface of the shroud 100 that corresponds to the position at which the swirlers 1231 are formed.

Therefore, compressed air A that flows into the combustor casing 1210 is pure compressed air A1. A part of the pure compressed air A1 is drawn into the shroud 100 through the inlets 200, and another part moves to a region including the first fuel injector 1211 and is mixed with first fuel F1. This pre-mixed air A2 moves around an inlet part 110 of the shroud 100 and enters the internal space of the shroud 100. Thereafter, while passing through the swirlers 1231, the pre-mixed air A2 is mixed with second fuel F2 injected through the second fuel injector 1232, thus forming pre-mixed air A3 having an increased fuel mixing ratio. The pre-mixed air A3 is additionally mixed with the pure compressed air A1 drawn into the shroud 100 through the inlets 200. Consequently, pre-mixed gas having an optimum mixing ratio for ignition and combustion can be supplied into the combustion chamber 1240, and reinforced high-pressure vortex currents are formed so that the continuity of flame holding can be ensured.

Furthermore, taking into account the distribution and collection rate of the initially drawn compressed air A1, it is preferable that the inlets 200 be disposed in a circumferential row only on that portion of the outer circumferential surface of the shroud 100 that faces the inner circumferential surface of the combustor casing 1210. More specifically, the inlets 200 may be disposed along the circumferential row such that 10% to 20% of the flow rate of compressed air A1 flowing outside the shroud 100 is drawn into the shroud 100.

If the flow rate of compressed air A1 drawn into the inlets 200 is less than 10% of the flow rate of compressed air A1 flowing outside the shroud 100, the flow rate at which pure compressed air A1 is supplied to the region formed around the second fuel injector 1232 provided on the swirlers 1231 is excessively low, whereby there is substantially a limit to overcoming the insufficient mixing and flame backflow problems of the burner 1220 to which the conventional shroud structure is applied. On the other hand, if the flow rate of compressed air A1 drawn into the inlets 200 is greater than 20% of the flow rate of compressed air A1 flowing outside the shroud 100, the amount of compressed air A to be pre-mixed with the first fuel F1 and the second fuel F2 is insufficient, thus leading to a relatively large amount of mixing ratio reduction.

FIGS. 5A and 5B illustrate embodiments of the inlet 200. Here, an inlet 200*a* and 200*b* may respectively include an air collector 201*a* and 201*b* and an inlet hole 202*a* and 202*b* formed in the shroud structure in accordance with the present disclosure.

Referring to FIGS. 5A and 5B, the air collector (201*a*, 201*b*) is formed around the inlet hole (202*a*, 202*b*) to artificially control the flow of compressed air such that compressed air flowing through a predetermined region around the inlet 200 flows through the inlet 200.

In FIG. 5A, the air collector 201*a* may be formed of a scoop welded to the outer circumferential surface of the shroud 100. An embodiment of the scoop form of the air collector 201*a* includes a curved welding part, a cover provided on the welding part, and a collecting region formed inside the cover. The curved welding part may be disposed adjacent to a perimeter of the inlet hole 202*a* and may protrude from the outer circumferential surface of the shroud 100, the cover may have a curved surface with a predetermined inlet diameter, and the collecting region may have an opening that faces an inlet direction of cooling compressed air. Here, the inlet hole 202*a*, which is partially enclosed by the scoop 201*a*, may pass through the outer wall of the shroud 100 in a linear manner, either perpendicularly (straight) or obliquely (inclined).

In FIG. 5B, the air collector 201*b* may be formed a portion of the outer circumferential surface of the shroud 100, by simultaneously forming the inlet hole 202*b* with formation of the air collector 201*b*. That is, a portion of the outer circumferential surface of the shroud 100 in which the inlet hole 202*b* is to be formed is punched and spread outward. According to this embodiment, the process of separately manufacturing and welding the air collector 201*a* can be omitted, so that the production time and cost can be reduced.

Furthermore, a flow rate adjustment unit (not shown) protruding into the internal space of the shroud 100 may be formed in the inlet 200. The flow rate adjustment unit includes a slot or an orifice to independently adjust the flow rate of air regardless of the diameter of the inlet hole 202*a* or the size of inlet hole 202*b*. The flow rate adjustment unit is not limited to the foregoing embodiment, and any unit can be used as the flow rate adjustment unit so long as it is a metal member having a tubular shape capable of selectively reducing the diameter/size of the hole.

FIGS. 6A and 6B respectively illustrate configurations of other embodiments of the shroud structure for improving swozzle flow in accordance with the present disclosure. FIGS. 7A and 7B detail the shroud structures of FIGS. 6A and 6B, respectively.

Referring to FIGS. 6A, 6B, 7A, and 7B, the inlets 200 may be disposed in at least two circumferential rows (R1, R2, R3). This arrangement may change depending on specifications of the burner 1220 or the shroud 100, e.g., their diameters and axial lengths, and whether it is formed of a single member. Given this, the purpose of this structure is to ensure a shroud structure capable of supplying compressed air A at an appropriate flow rate into the internal space of the shroud 100. In each of FIGS. 6A and 6B, inlets 200 are further disposed along an additional circumferential row to ensure an appropriate flow rate of compressed air.

In the embodiment of FIG. 6A, inlets 210 and 220 are disposed on two circumferential rows R1 and R2, which may be spaced apart from each other along the axial direction before the circumferential row RX of the outer circumferential surface of the shroud 100 that corresponds to the position at which the swirlers 1231 are formed.

In the embodiment of FIG. 6B, an additional circumferential row for inlets 300 may be specified in a region between the circumferential row RY of the outer circumferential surface of the shroud 100 that faces the first fuel injector 1211 and the circumferential row RX of the outer circumferential surface of the shroud 100 that corresponds to the position at which the swirlers 1231 are formed.

As such, the number of circumferential rows in which inlets are disposed, the disposition of the circumferential rows, the diameter/size of each inlet hole, the distribution of inlets in the circumferential rows, etc. may be changed such that the flow rate of compressed air to be drawn into the inlet holes is limited to an appropriate flow rate, e.g., 10% to 20% of the flow rate of compressed air flowing outside the shroud 100, taking into account the relativity of the structure or shape of the shroud 100 according to the product or kind of product.

Furthermore, in the case where two or more circumferential rows are provided, inlets 200 disposed in a first circumferential row R1 and a second circumferential row R2 may be alternately disposed with respect to a circumferential row so as to make it possible for compressed air to be drawn into the inlets 200 at an appropriate flow rate.

FIG. 8 illustrates a burner assembly to which the shroud structure for improving swozzle flow in accordance with the present disclosure is applied.

As described above, a plurality of burners 1220 forms a burner assembly 400 in which the burners 1220 are disposed along the inside of the combustor casing 1210 having an annular shape. A center burner 1220*a* may be provided in an internal center of the combustor casing 1210, and a plurality of auxiliary burners 1220*b* may be provided around the center burner 1220*a*. The number and relative diameters of the auxiliary burners 1220*b* may be appropriately selected, taking into account the flow rate of compressed air, the speed of the swozzle flow, and so forth.

Referring to FIG. 8, the inlets 200 may be formed in the outer circumferential surfaces of the shrouds of only the auxiliary burners 1220*b*. In the structure of each shroud 100 having the inlets 200, the inlets 200 are formed in the outer circumferential surface of the shroud 100 such that compressed air flowing outside the shroud 100 is drawn into the shroud 100 before being mixed with fuel. Here, the inlets 200 are disposed before the circumferential row of the outer circumferential surface of the shroud 100 that faces the first fuel injector 1211 provided on the inner circumferential surface of the combustor casing 1210 so that compressed air guided into the inlet holes 200 is supplied to the region formed around the second fuel injector 1232 provided on the swirlers 1231 in the shroud 100.

In this way, the shroud structure may be configured such that, taking into account a collecting rate and distribution of compressed air A initially drawn into the combustor casing 1210, the proportion of the sum of flow rates of compressed air drawn into the plurality of burners 1220 to the total flow rate of compressed air drawn into the combustor casing 1210 can be limited to a proportion optimized for substantial combustion, for example, 10% to 20%.

Moreover, in order to realize reinforcement of the flame holding function and improvement in substantial mixing effect for effective combustion based on the overall structure of the burner assembly and the complex swozzle flow, the inlets 200 spaced apart from each other along a circumferential row may be disposed in the outer circumferential surfaces of the shroud 100 of only the burners that face the combustor casing 1210. Preferably, the inlets 200 may be disposed in only a specific region, i.e., a one-half circumferential surface region, of the outer circumferential surface of the shroud of each burner facing the combustor casing 1210.

As described above, as a shroud structure in accordance with the present disclosure is applied to a combustor burner and a gas turbine including the combustor burner, the effect of mixing compressed air and fuel provided for pre-mixed combustion is maximized, and an air barrier in the shroud is reinforced so that flashback (backfire) can be more reliably blocked.

Furthermore, since pure compressed air is drawn at an optimum flow rate into the shroud through which pre-mixed air passes, the amount of nitrogen oxide, etc. can be reduced, so that the quality of exhaust gas of the gas turbine can be improved.

While the shroud structure for improving swozzle flow and a combustor burner using the shroud structure in accordance with the present disclosure have been described with respect to the specific embodiments, it will be apparent to those skilled in the art that various changes and modifications may be made without departing from the spirit and scope of the disclosure as defined in the following claims.

Therefore, it should be understood that the exemplary embodiments are only for illustrative purposes and do not limit the bounds of the present invention.

What is claimed is:

1. A shroud structure for improving swozzle flow, comprising:

a shroud configured to surround a combustion nozzle and a plurality of swirlers provided along a circumferential row RX of an outer circumferential surface of the shroud in which a plurality of inlets are formed to draw in compressed air flowing outside the shroud, the compressed air being drawn into the shroud before being mixed with fuel, a first fuel injector provided on an inner circumferential surface of a combustor casing and faces a circumferential row RY of an outer circumferential surface of the shroud, wherein the plurality of inlets are disposed upstream of the circumferential row RY of the outer circumferential surface of the shroud that faces the first fuel injector so that the compressed air guided into the plurality of inlets is supplied to a region formed around a second fuel injector provided in the plurality of swirlers in the shroud, and wherein the plurality of inlets comprise:

a first inlet disposed along a first circumferential row (R1) of the outer circumferential surface of the shroud, the first circumferential row positioned before the plurality of swirlers; and a second inlet disposed along a second circumferential row (R3) of the outer circumferential surface of the shroud, the second circumferential row positioned after the circumferential row RX and positioned before the circumferential row RY, such that the second inlet is disposed in a region between the circumferential row RY and the circumferential row RX.

2. The shroud structure according to claim 1, wherein the first inlet comprises a plurality of first inlets spaced apart from each other along the first circumferential row, and wherein the second inlet comprises a plurality of second inlets spaced apart from each other along the second circumferential row.

3. The shroud structure according to claim 1, wherein the plurality of inlets are disposed in only a specific portion of the outer circumferential surface of the shroud, the specific portion equaling one half of the outer circumferential surface of the shroud, the one half of the outer circumferential surface of the shroud facing the inner circumferential surface of the combustor casing.

4. The shroud structure according to claim 1, wherein the plurality of inlets are disposed such that the compressed air drawn into the shroud represents 10% to 20% of a flow rate of the compressed air flowing outside the shroud.

5. The shroud structure according to claim 1, wherein each inlet of the plurality of inlets comprises an air collector provided around an inlet hole, the air collector configured to gather the compressed air flowing through a predetermined region around the inlet hole and to direct the gathered compressed air through the inlet hole.

6. The shroud structure according to claim 5, wherein the air collector is formed of a scoop.

7. The shroud structure according to claim 5, wherein the air collector is formed by punching and pressing outward a portion of the outer circumferential surface of the shroud in which the inlet hole is to be formed.

8. The shroud structure according to claim 2, wherein the plurality of first inlets and the plurality of second inlets are offset from each other in a circumferential direction to enable the compressed air to be drawn into each of the plurality of first inlets and into each of the plurality of second inlets at an appropriate flow rate.

9. A burner configured to form a combustor and provided with a shroud structure for improving swozzle flow, the burner comprising:

a combustion nozzle configured to eject fuel to be mixed with compressed air;

a plurality of swirlers provided along a circumferential direction of the combustion nozzle; and a shroud configured to surround the combustion nozzle and to house the plurality of swirlers to form the swozzle flow of pre-mixed air, the shroud having an outer circumferential surface in which a plurality of inlets are formed to draw in the compressed air flowing outside the shroud, the compressed air being drawn into the shroud before being mixed with the fuel, wherein the plurality of swirlers are provided along a circumferential row RX of the outer circumferential surface of the shroud, a first fuel injector provided on an inner circumferential surface of a combustor casing and faces a circumferential row RY of an outer circumferential surface of the shroud, wherein the plurality of inlets are disposed upstream of the circumferential row RY of the outer circumferential surface of the shroud that faces the first fuel injector so that the compressed air guided into the plurality of inlets is supplied to a region formed around a second fuel injector provided in the plurality of swirlers in the shroud, and wherein the plurality of inlets comprise:

a first inlet disposed along a first circumferential row (R1) of the outer circumferential surface of the shroud, the first circumferential row positioned before the plurality of swirlers; and a second inlet disposed along a second circumferential row (R3) of the outer circumferential surface of the shroud, the second circumferential row positioned after the circumferential row RX and positioned before the circumferential row RY, such that the second inlet is disposed in a region between the circumferential row RY and the circumferential row RX.

10. The burner according to claim 9, wherein the first inlet comprises a plurality of first inlets spaced apart from each other along the first circumferential row, and wherein the second inlet comprises a plurality of second inlets spaced apart from each other along the second circumferential row.

11. The burner according to claim 9, wherein the plurality of inlets are disposed in only a specific portion of the outer circumferential surface of the shroud, the specific portion equaling one half of the outer circumferential surface of the shroud, the one half of the outer circumferential surface of the shroud facing the inner circumferential surface of the combustor casing.

12. The burner according to claim 9, wherein the plurality of inlets are disposed such that the compressed air drawn into the shroud represents 10% to 20% of a flow rate of the compressed air flowing outside the shroud.

13. A burner assembly in which a plurality of burners are disposed along a combustor casing having an annular shape, each burner comprising:

a combustion nozzle configured to eject fuel to be mixed with compressed air;

a plurality of swirlers provided along a circumferential direction of the combustion nozzle;

and a shroud configured to surround the combustion nozzle and to house the plurality of swirlers to form a swozzle flow of pre-mixed air, the shroud having an outer circumferential surface in which a plurality of inlets are formed to draw in the compressed air flowing outside the shroud, the compressed air being drawn into the shroud before being mixed with the fuel, wherein the plurality of swirlers are provided along a circumferential row RX of the outer circumferential surface of the shroud, a first fuel injector provided on an inner circumferential surface of a combustor casing and faces a circumferential row RY of an outer circumferential surface of the shroud, wherein the plurality of inlets are disposed upstream of the circumferential row RY of the outer circumferential surface of the shroud that faces the first fuel injector so that the compressed air guided into the plurality of inlets is supplied to a region formed around a second fuel injector provided in the plurality of swirlers in the shroud, and wherein the plurality of inlets comprise:

a first inlet disposed along a first circumferential row (R1) of the outer circumferential surface of the shroud, the first circumferential row positioned before the plurality of swirlers; and a second inlet disposed along a second circumferential row (R3) of the outer circumferential surface of the shroud, the second circumferential row positioned after the circumferential row RX and positioned before the circumferential row RY, such that the second inlet is disposed in a region between the circumferential row RY and the circumferential row RX.

14. The burner assembly according to claim 13, wherein the plurality of burners comprises:

a center burner provided in an internal center of the combustor casing, and a plurality of auxiliary burners provided around the center burner, wherein the plurality of inlets are formed in the outer circumferential surface of each of the shrouds of only the plurality of auxiliary burners.

15. The burner assembly according to claim 13, wherein the plurality of inlets are formed in the outer circumferential surface of each of the shrouds of only the plurality of burners that face the combustor casing.

16. The burner assembly according to claim 13, wherein the first inlet comprises a plurality of first inlets spaced apart from each other along the first circumferential row, and wherein the second inlet comprises a plurality of second inlets spaced apart from each other along the second circumferential row.

17. The burner assembly according to claim 13, wherein the plurality of inlets are disposed such that the compressed air drawn into the shroud represents 10% to 20% of a flow rate of the compressed air flowing outside the shroud.

* * * * *